US012434116B2

(12) United States Patent
Cameron et al.

(10) Patent No.: US 12,434,116 B2
(45) Date of Patent: Oct. 7, 2025

(54) PUTTER WITH IMPROVED CONSTRUCTION AND ALIGNMENT

(71) Applicant: Acushnet Company, Fairhaven, MA (US)

(72) Inventors: Don T. Cameron, Carlsbad, CA (US); Augustin W. Rollinson, Del Mar, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 18/446,374

(22) Filed: Aug. 8, 2023

(65) Prior Publication Data

US 2025/0050179 A1 Feb. 13, 2025

(51) Int. Cl.
*A63B 53/04* (2015.01)
*A63B 60/04* (2015.01)

(52) U.S. Cl.
CPC ..... *A63B 53/0487* (2013.01); *A63B 53/0441* (2020.08); *A63B 60/04* (2015.10); *A63B 2053/0491* (2013.01)

(58) Field of Classification Search
CPC ..... A63B 53/0487
USPC ..... 473/340
See application file for complete search history.

(56) References Cited

U.S. PATENT DOCUMENTS 1,618,638 A 2/1927 Coles
D222,280 S 10/1971 Cook
3,841,640 A * 10/1974 Gaulocher ..... A63B 69/3685 473/341
3,880,430 A 4/1975 McCabe
3,888,492 A 6/1975 Cabot
D235,668 S 7/1975 Swash
3,931,975 A 1/1976 Cook
3,954,270 A 5/1976 Cook
3,966,210 A 6/1976 Rozmus
4,002,343 A 1/1977 Eckert
4,043,562 A 8/1977 Shillington
4,113,249 A 9/1978 Beery
4,128,244 A 12/1978 Duclos
4,136,877 A 1/1979 Antonious
4,140,318 A 2/1979 Izett et al.
4,163,554 A 8/1979 Bernhardt
4,227,694 A 10/1980 Drake
4,231,576 A 11/1980 Perkins
4,265,451 A 5/1981 Bernhardt
4,411,429 A 10/1983 Drew et al.
(Continued)

FOREIGN PATENT DOCUMENTS

JP 06218084 A * 8/1994
JP 3052104 U 9/1998
(Continued)

OTHER PUBLICATIONS

Final Office Action dated Nov. 9, 2016 issued in U.S. Appl. No. 14/253,041.

(Continued)

*Primary Examiner* — Alvin A Hunter
(74) *Attorney, Agent, or Firm* — Ryan A. Reis

(57) ABSTRACT

A putter having a body made from at least three separate components joined together. At least two of the components making up the body of the putter containing sightlines for aiding in putter alignment.

19 Claims, 4 Drawing Sheets

(56) References Cited

U.S. PATENT DOCUMENTS 4,458,900 A 7/1984 Antonious
4,540,178 A * 9/1985 Johnson ..... A63B 60/00 228/101
4,712,797 A 12/1987 Kovalchek
4,722,528 A 2/1988 Tsao
4,934,702 A 6/1990 Serizawa
4,986,544 A 1/1991 Benson
5,324,031 A * 6/1994 Green ..... A63B 53/0487 473/340
5,351,963 A 10/1994 Baek
5,407,194 A 4/1995 Snow
5,417,429 A 5/1995 Strand
5,464,215 A 11/1995 Koehler
5,464,218 A 11/1995 Schmidt et al.
5,470,070 A 11/1995 Bendo
5,482,281 A * 1/1996 Anderson ..... A63B 53/0487 473/341
5,494,282 A * 2/1996 Pranio ..... A63B 53/0487 473/340
5,501,453 A 3/1996 Hurst
5,542,675 A * 8/1996 Micciche ..... A63B 53/0487 473/340
5,569,098 A * 10/1996 Klein ..... A63B 53/007 473/316
5,628,694 A 5/1997 O'Connor, Jr.
5,630,765 A 5/1997 Moore
5,643,100 A * 7/1997 Zabytko ..... A63B 53/0487 473/250
5,676,606 A * 10/1997 Schaeffer ..... A63B 53/0487 473/340
5,683,307 A 11/1997 Rife
5,749,791 A 5/1998 Passeri, Jr.
5,797,176 A * 8/1998 Rose ..... A63B 53/0487 473/340
5,816,930 A 10/1998 Brown
5,820,481 A * 10/1998 Raudman ..... A63B 53/0487 473/340
5,890,969 A * 4/1999 Bechler ..... A63B 53/02 473/340
5,911,638 A 6/1999 Parente et al.
5,913,731 A 6/1999 Westerman
5,921,868 A 7/1999 DiMartino
6,024,652 A * 2/2000 Westbrook ..... A63B 60/02 473/340
6,048,275 A 4/2000 Gedeon
6,062,986 A 5/2000 Kaise
6,080,070 A 6/2000 Whitley
6,117,020 A 9/2000 Currie
6,126,556 A * 10/2000 Hsieh ..... A63B 53/047 473/340
6,241,624 B1 * 6/2001 Zabytko ..... A63B 60/00 473/340
6,261,190 B1 7/2001 Ashcraft
6,270,422 B1 8/2001 Fisher
6,319,146 B1 11/2001 Mills
6,350,208 B1 2/2002 Ford
6,485,375 B1 * 11/2002 McKinley ..... A63B 60/02 473/340
6,558,268 B2 5/2003 Tindale
6,796,911 B2 9/2004 Grace
6,837,801 B1 1/2005 Souza et al.
6,878,072 B1 4/2005 Henry
6,902,496 B2 6/2005 Solheim et al.
6,926,615 B1 8/2005 Souza et al.
6,958,019 B2 10/2005 Rohrer
6,960,140 B2 11/2005 Solheim et al.
6,984,181 B2 * 1/2006 Hettinger ..... A63B 53/0487 473/340
6,988,956 B2 * 1/2006 Cover ..... A63B 60/02 473/340
7,004,849 B2 2/2006 Cameron et al.
D521,582 S 5/2006 Souza et al.
7,048,646 B2 5/2006 Yamanaka et al.
7,052,409 B2 5/2006 Goldsmith
7,077,758 B2 7/2006 Rohrer
7,108,611 B2 * 9/2006 MacIlraith ..... A63B 53/06 473/340
7,121,954 B2 10/2006 Charron
7,147,569 B2 12/2006 Tang et al.
7,163,469 B2 1/2007 Banneau
7,166,039 B2 1/2007 Hettinger et al.
D540,897 S 4/2007 Oldknow et al.
7,235,021 B2 6/2007 Solheim et al.
D564,606 S 3/2008 Oldknow et al.
7,344,451 B2 * 3/2008 Tang ..... A63B 53/0487 473/340
7,371,184 B2 5/2008 Tao
7,374,497 B2 5/2008 Brown
7,407,443 B2 8/2008 Franklin et al.
7,438,648 B2 10/2008 Wahl et al.
7,448,963 B2 11/2008 Beach et al.
7,455,599 B2 * 11/2008 Jones ..... A63B 53/0487 473/340
7,462,111 B2 * 12/2008 Little ..... A63B 53/0487 473/340
7,491,131 B2 2/2009 Vinton
7,578,752 B1 8/2009 Flores
7,588,499 B2 9/2009 Tateno
7,611,419 B2 11/2009 O'Neill
D607,950 S 1/2010 Souza et al.
7,789,764 B2 9/2010 Wilson et al.
7,815,515 B1 10/2010 Hunt
7,824,275 B2 11/2010 Sussich
7,828,675 B2 * 11/2010 Hilton ..... A63B 53/0487 473/340
7,833,108 B2 11/2010 Hosowich
7,918,745 B2 4/2011 Morris et al.
7,922,596 B2 4/2011 Vanderbilt et al.
7,927,226 B1 4/2011 Twitty
7,959,519 B2 6/2011 Zielke et al.
8,100,779 B2 1/2012 Solheim et al.
8,109,838 B2 * 2/2012 Solheim ..... A63B 60/00 473/409
8,128,505 B2 3/2012 Tryner et al.
8,308,583 B2 11/2012 Morris et al.
8,328,654 B2 12/2012 Demkowski et al.
8,371,958 B2 2/2013 Treadwell
8,382,605 B2 2/2013 Treadwell
8,480,504 B2 7/2013 Hilton et al.
8,523,698 B2 * 9/2013 Hotaling ..... A63B 53/04 473/340
8,632,415 B1 1/2014 Smith
8,932,144 B2 1/2015 Simizu
D730,464 S 5/2015 Cameron
9,220,960 B2 12/2015 Schartiger
9,227,115 B2 1/2016 Cameron
9,248,352 B1 2/2016 Patten
9,717,961 B2 8/2017 Cameron
9,987,531 B2 6/2018 Cameron
10,124,220 B2 11/2018 Cameron
10,363,464 B2 7/2019 Cameron
11,020,640 B2 * 6/2021 Higdon ..... A63B 53/065
D959,581 S 8/2022 Parsons et al.
11,452,922 B2 * 9/2022 Spackman ..... A63B 60/02
11,458,375 B2 * 10/2022 Higdon ..... A63B 53/0487
11,673,035 B2 * 6/2023 Demkowski ..... A63B 60/02 473/251
11,813,508 B2 * 11/2023 Higdon ..... A63B 53/0437
2002/0065144 A1 * 5/2002 Helmstetter ..... C08G 18/10 473/340
2002/0098908 A1 * 7/2002 James ..... A63B 53/0487 473/340
2002/0098912 A1 * 7/2002 Anderson ..... A63B 60/54 473/340
2002/0107086 A1 * 8/2002 Cameron ..... A63B 53/065 473/340
2003/0045373 A1 * 3/2003 Field ..... A63B 53/02 473/340
2004/0058743 A1 * 3/2004 Hettinger ..... A63B 53/0487 473/340
2004/0209702 A1 10/2004 Charron et al.

(56) References Cited

U.S. PATENT DOCUMENTS

| | | | | |
|---|---|---|---|---|
| 2004/0214659 | A1* | 10/2004 | Lindsay | A63B 53/0487 473/340 |
| 2005/0037858 | A1* | 2/2005 | Lukasiewicz | A63B 53/0487 473/340 |
| 2005/0096153 | A1* | 5/2005 | Stoakes | A63B 53/0487 473/340 |
| 2005/0137027 | A1 | 6/2005 | Thomas | |
| 2005/0227782 | A1* | 10/2005 | Little | A63B 53/0487 473/340 |
| 2006/0019766 | A1* | 1/2006 | Kubota | A63B 53/0487 473/340 |
| 2006/0019767 | A1 | 1/2006 | Bonneau | |
| 2006/0234810 | A1* | 10/2006 | Chiodo | A63B 60/02 473/340 |
| 2006/0258475 | A1 | 11/2006 | Lee | |
| 2007/0021230 | A1* | 1/2007 | Haack | A63B 60/02 473/340 |
| 2007/0105652 | A1 | 5/2007 | Beach et al. | |
| 2007/0142122 | A1* | 6/2007 | Bonneau | A63B 53/0487 473/340 |
| 2007/0238547 | A1* | 10/2007 | Jones | A63B 53/0487 473/340 |
| 2007/0298904 | A1 | 12/2007 | Dworzan | |
| 2009/0170629 | A1* | 7/2009 | Hilton | A63B 53/0487 473/340 |
| 2010/0184527 | A1* | 7/2010 | Demkowski | A63B 53/0487 473/340 |
| 2013/0157774 | A1 | 6/2013 | Chen | |
| 2014/0179459 | A1 | 6/2014 | Schartiger et al. | |
| 2015/0080147 | A1* | 3/2015 | Cameron | A63B 53/04 473/340 |
| 2015/0080148 | A1 | 3/2015 | Cameron | |

FOREIGN PATENT DOCUMENTS

| | | | | | |
|---|---|---|---|---|---|
| JP | H1189981 | A | | 4/1999 | |
| JP | 2005046442 | A | | 2/2005 | |
| JP | 2005137913 | A | * | 6/2005 | A63B 53/0487 |
| JP | 2005518885 | A | | 6/2005 | |
| JP | 2006247320 | A | | 9/2006 | |
| JP | 2006326216 | A | | 12/2006 | |
| JP | 2007029648 | A | | 2/2007 | |
| JP | 2007175202 | A | * | 7/2007 | A63B 53/0487 |
| JP | 2008132197 | A | | 6/2008 | |
| JP | 2010284434 | A | | 12/2010 | |
| JP | 2021090722 | A | * | 6/2021 | A63B 53/0487 |
| JP | 2022504044 | A | | 1/2022 | |

OTHER PUBLICATIONS

European Search Report issued in EP application No. 24193713.5, dated Dec. 12, 2024 in 9 pages.

* cited by examiner

PUTTER WITH IMPROVED CONSTRUCTION AND ALIGNMENT

FIELD OF THE INVENTION

The present invention relates to a golf club, and, more particularly, the present invention relates to a golf putter having a body made from at least three separate components and sightlines formed on multiple components.

DESCRIPTION OF THE RELATED ART

Golf club heads come in many different forms and makes, such as metal-woods, irons (including wedges), utility- or hybrid- or specialty-type clubs, and putters. Each of these styles has a prescribed function and general construction. The present invention primarily relates to putters, which typically are used to strike a golf ball and impart a rolling path on the greens of a course.

There are many styles of putters that provide different advantages. Putters are also governed by the rules of golf set by the USGA. The rules include the heel-toe dimension, the front-to-back dimension, the neck length, the face angle, the lie angle and that the putter shall not be substantially different from the customary and traditional form.

SUMMARY OF THE INVENTION

In some aspects, the techniques described herein relate to a putter including: a first body member including a striking face and a rear portion extending rearward from the striking face in an address position; a second body member coupled to the first body member below the rear portion of the first body member and rearward of the striking face in the address position; a third body member coupled to the second body member below the second body member in the address position; and a face center plane that passes through a face center of the striking face and is perpendicular to a ground plane in the address position, wherein the first body member, the second body member, and the third body member are visible to a golfer in the address position.

In some aspects, the techniques described herein relate to a putter including: a first body member including a striking face and a rear portion extending rearward from the striking face in an address position; a second body member coupled to the first body member below the rear portion of the first body member and rearward of the striking face in the address position; a third body member coupled to the second body member below the second body member in the address position; and a face center plane that passes through a face center of the striking face and is perpendicular to a ground plane in the address position, wherein the first body member is made from a first material having a first density, wherein the second body member is made from a second material having a second density, wherein the third body member is made from a third material having a third density, wherein the second density is less than the first density, wherein the second density is less than the third density, wherein the first body member includes at least one sightline, and wherein the second body member includes a plurality of sightlines.

BRIEF DESCRIPTION OF THE DRAWINGS

The present invention is described with reference to the accompanying drawings, in which like reference characters reference like elements, and wherein.

DETAILED DESCRIPTION OF THE INVENTION

Figure 1:
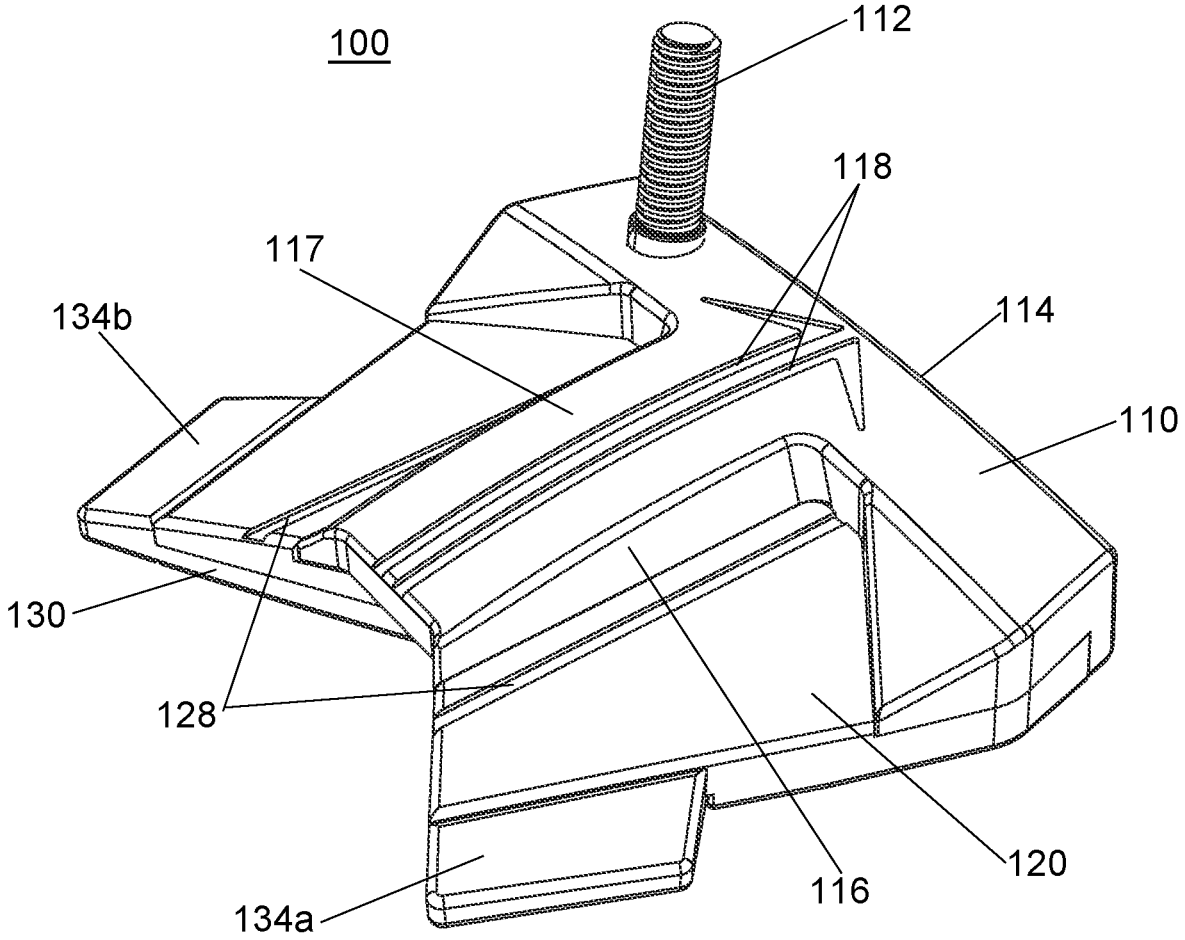
FIG. 1 shows a top perspective view of a putter of the present invention.
Figure 2:
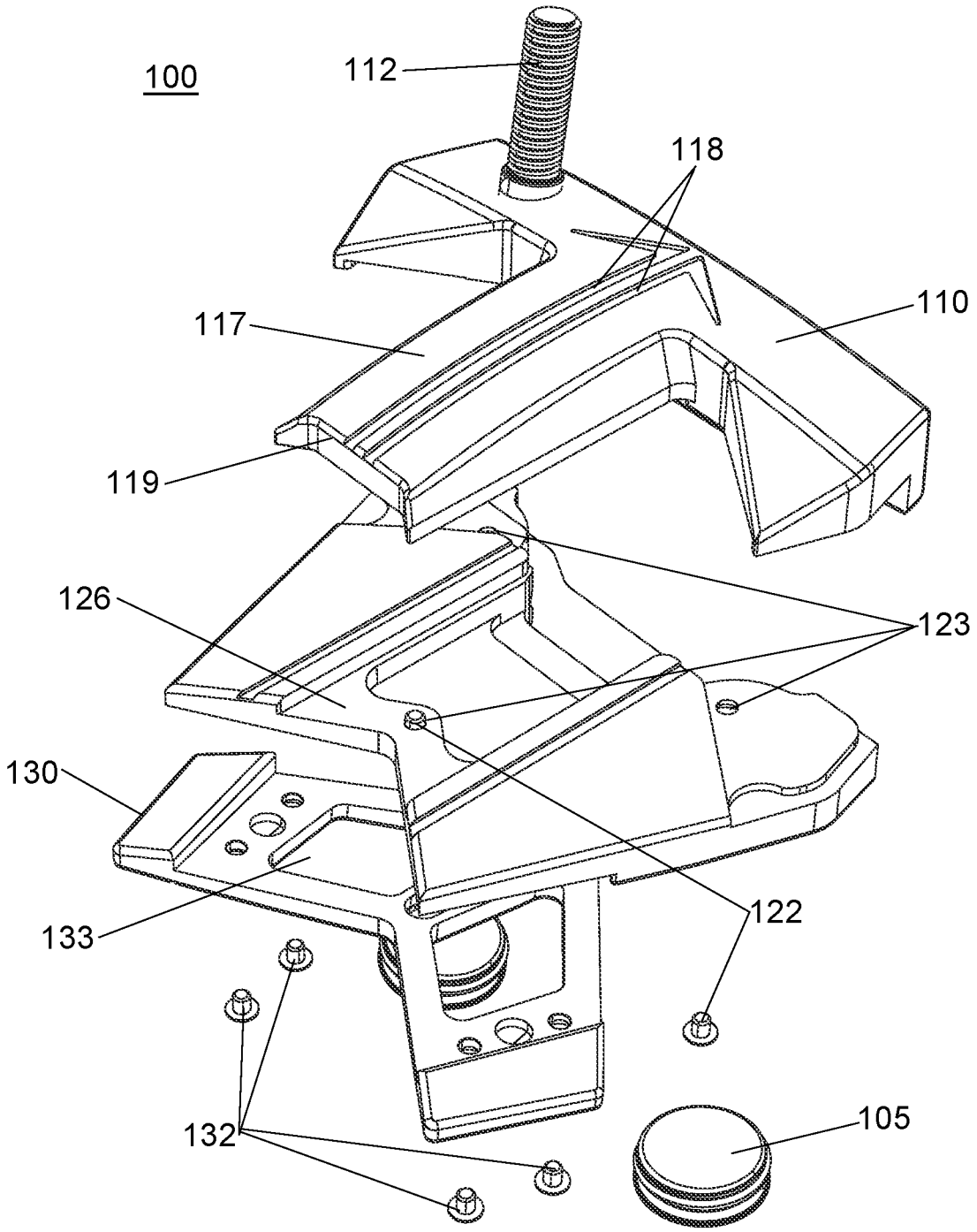
FIG. 2 shows an exploded top perspective view of the putter of FIG. 1.
Figure 3:
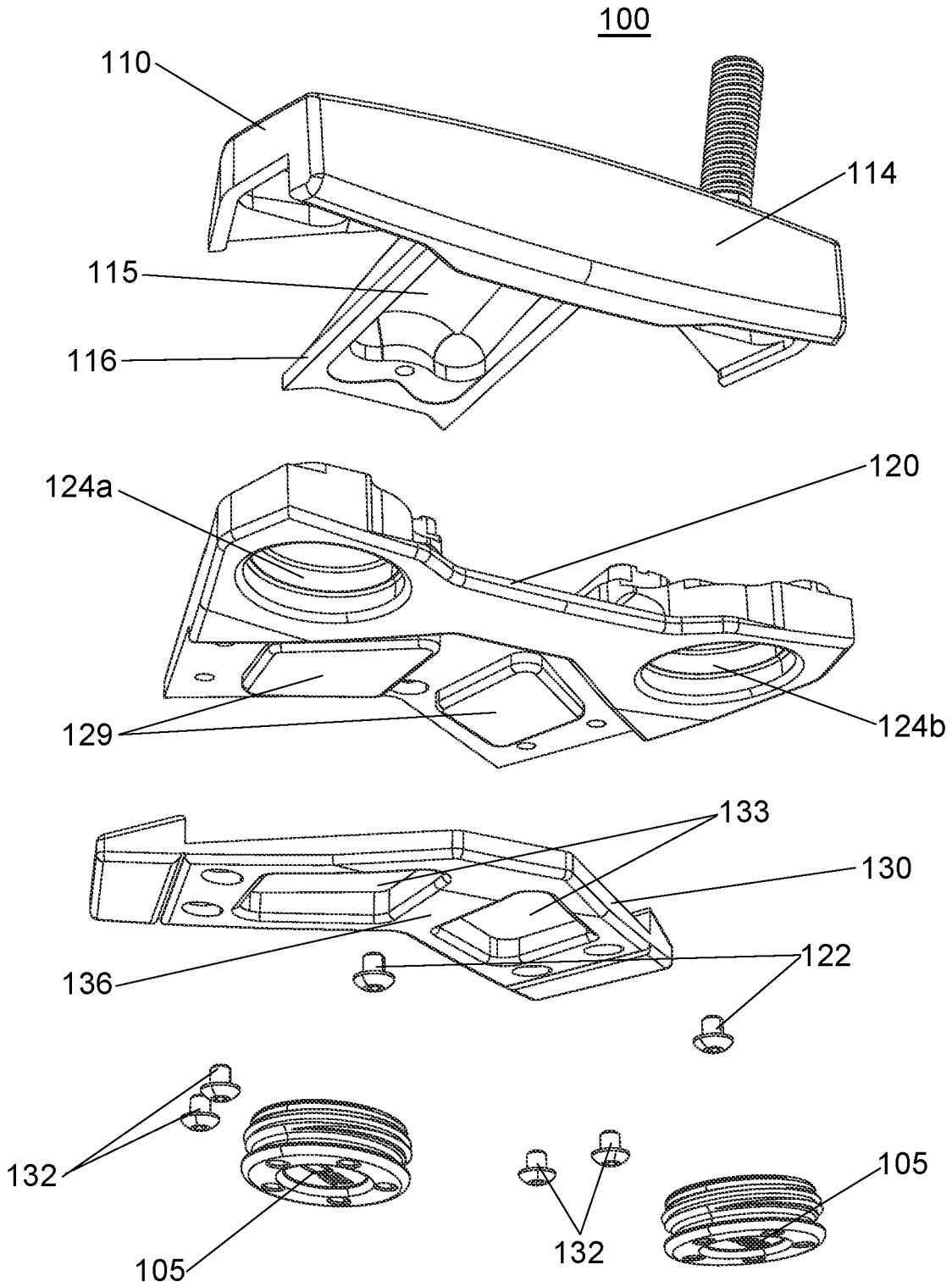
FIG. 3 shows an exploded bottom perspective view of the putter of FIG. 1.
Figure 4:
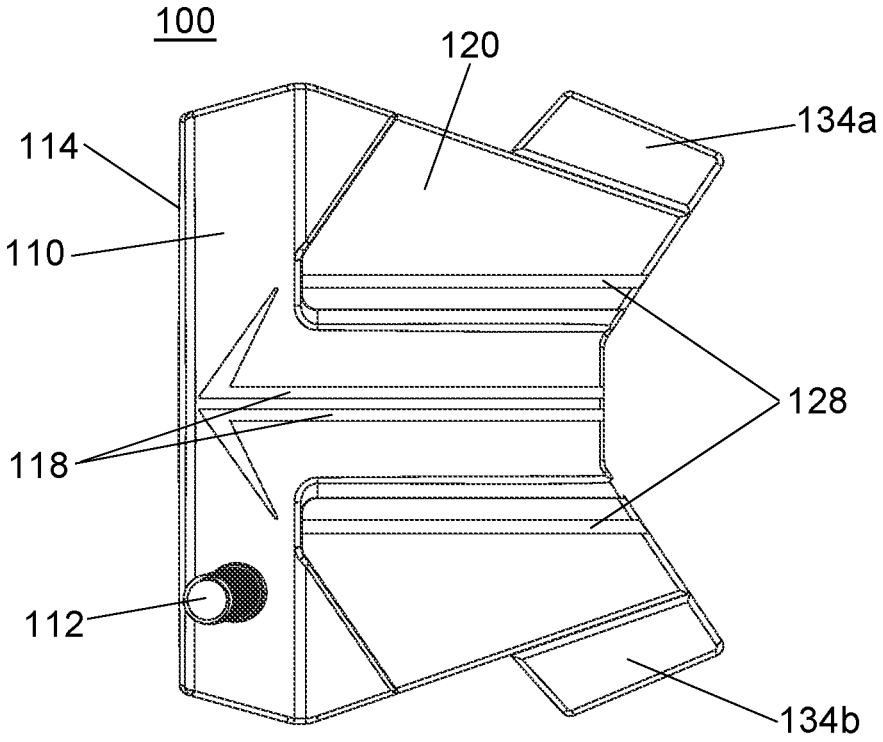
FIG. 4 shows a top view of the putter of FIG. 1.
Figure 5:
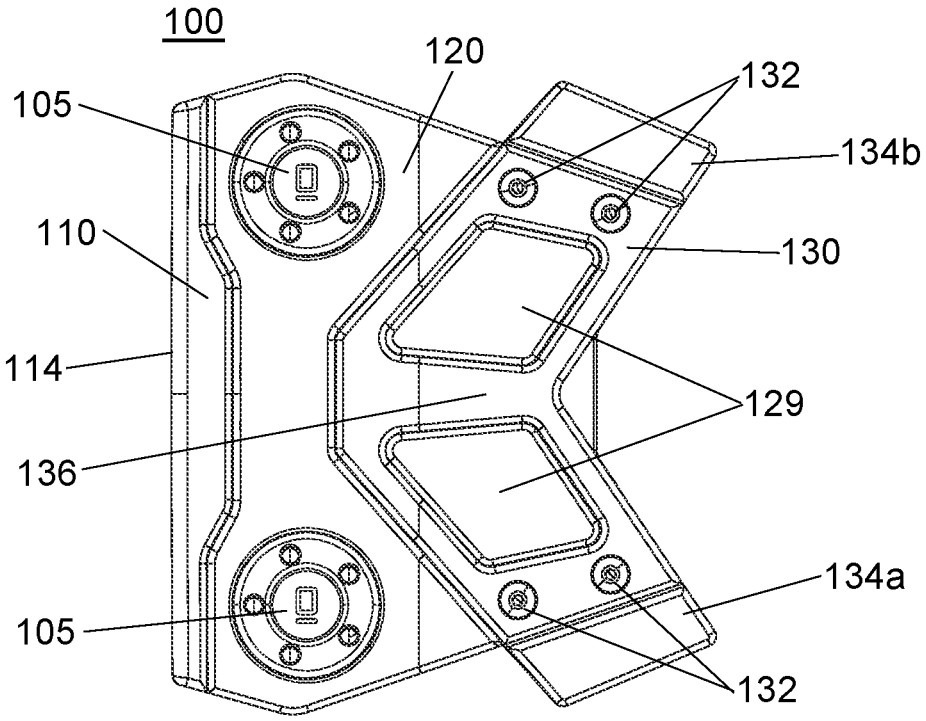
FIG. 5 shows a bottom view of the putter of FIG. 1.

Referring to FIGS. 1-5, the present invention is directed to a putter 100. The putter 100 includes a first body member 110, a second body member 120, and a third body member 130. Constructing the putter 100 with the first body member 110, the second body member 120, and the third body member 130, as described in greater detail below, allows for greater weight distribution in the putter 100 for improved sound, feel, and forgiveness and creates a contrast between body members which improves a golfer's ability to align the putter 100 towards an intended target. The first body member 110 includes a striking face 114 for impacting the golf ball during the putting stroke. The first body member 110 in this embodiment includes a hosel 112 that is coupled to a shaft and grip as is well known in the art. The first body member 110 includes a rear portion 116 extending rearward from the striking face 114 having an upper surface 117 that can be seen by the golfer in the address position. The rear portion 116 may include a cavity 115 to allow weight to be distributed to other areas of the putter 100.

The first body member 110 also includes at least one sightline 118 on the upper surface 117 of the rear portion 116 that extends rearwardly from the striking face 114. The at least one sightline 118 may extend from the striking face 114 to a rearmost edge 119 of the first body member 110 to provide a maximum length for the at least one sightline 118 and further aid the golfer in proper alignment of the putter 100. The at least one sightline 118 may be formed as a groove, a protrusion, or a painted line on the upper surface 117. The at least one sightline 118 may be in the shape of an arrow to assist the golfer in aligning the putter 100 towards the target. In a preferred embodiment, the first body member 110 is one color such as grey or black and the at least one sightline 118 is a different, contrasting color. For example, if first body member 110 is black, the at least one sightline 118 may be red, white, silver or other bright color. If the first body member 110 is grey, the at least one sightline 118 may be red, white, black or other contrasting color. In a preferred embodiment, a golfer may select a color of the at least one sightline 118 in order to personalize the putter 100. The first body member 110 is made of a first material having a first density. In the most preferred embodiment, the first body member 110 is formed of steel and has a density of about 7 g/cc to 8 g/cc.

The putter 100 includes the second body member 120 that is coupled to the first body member 110 via fasteners 122. The second body member 120 is located below the first body member 110 and rearward of the striking face 114 in the address position. The second body member 120 includes a first weight port **124*a* located on a toe side of a face center plane that passes through a face center of the striking face 114 and is perpendicular to the ground plane at the address position. The second body member 120 also includes a second weight port 124*b* located on a heel side of the face center plane. Fasteners 122 may be inserted through apertures 123 located in the first weight port 124*a* and the second weight port 124***b* to couple the second body member 120 to the first body member 110. The putter 100 includes weight members 105 which may be removably inserted into the first weight port 124*a* and the second weight port 124*b*. Preferably, the weight members 105 are formed of steel or tungsten. The weight members 105 may each be formed to weigh between 10 grams and 50 grams. The weight members 105 may be located equidistant from the face center plane to increase the moment of inertia of the putter 100. The weight members 105 may be threaded and act as covers to protect the fasteners 122 from corrosion and wear as well as unwanted disassembly of the second body member 120 from the first body member 110. The second body member 120 may include a central groove 126 that receives the rear portion 116 of the first body member 110 when assembled. The central groove 126 acts as a locating feature to assist in proper alignment of the first body member 110 with the second body member 120 during assembly. The central groove 126 may include at least one aperture 123 that receives at least one of the fasteners 122 to couple the second body member 120 to the first body member 110.

The second body member 120 includes sightlines 128 located on either side of the central groove 126 on a top surface of the second body member 120 such that the sightlines 128 are visible to the golfer in the address position. The sightlines 128 may be formed as grooves, protrusions, or painted lines on the second body member 120. In a preferred embodiment, the second body member 120 is one color such as grey or black and the sightlines 128 are a different, contrasting color. For example, if second body member 120 is black, the sightlines 128 may be red, white, silver or other bright color. If the second body member 120 is grey, the sightlines 128 may be red, white, black or other contrasting color. In a preferred embodiment, a golfer may select a color of the sightlines 128 in order to personalize the putter 100. The sightlines 128 are parallel to each other and are positioned to extend perpendicular to the striking face 114. Preferably, the sightlines 128 are spaced apart by greater than 1.0 inch. In another preferred embodiment, the sightlines 128 are spaced apart by about 1.6 inches to correspond to the width of a golf ball. The sightlines 128 are preferably equally spaced about the face center plane. The sightlines 128 may be located a distance greater than 0.1 inches below the upper surface 117 of the first body member 110 in a direction perpendicular to the ground plane at the address position. The second body member 120 is preferably made of a color different than the color of the first body member 110. The contrasting colors of the first body member 110 and the second body member 120 provides greater visual alignment of the putter 100. The second body member 120 is made of a second material having a second density which is less than the density of the first material of the first body member 110. In the most preferred embodiment, the second body member 120 is formed of aluminum having a density of about 2.5 g/cc to 3 g/cc.

The putter 100 also includes the third body member 130 that is coupled to the second body member 120 via fasteners 132. The third body member 130 may include at least one aperture 133 which receives at least one projection 129 located on a bottom surface of the second body member 120 when assembled. The at least one aperture 133 acts as a locating feature to assist in proper alignment of the second body member 120 with the third body member 130 during assembly. The at least one aperture 133 also allows weight to be distributed to other areas of the putter 100 for improved sound, feel, and forgiveness. The third body member 130 includes a first projection 134*a* located on a toe side of the face center plane and a second projection 134*b* located on a heel side of the face center plane. The first projection 134*a* and the second projection 134*b* distribute weight in toeward and heelward directions to increase the moment of inertia and forgiveness of the putter 100. The first projection 134*a* and the second projection 134*b* are visible to the golfer at the address position to further provide contrast for improved visual alignment. The third body member 130 may include a central portion 136 which acts as a cover to protect at least one of the fasteners 122 from corrosion and wear as well as unwanted disassembly of the second body member 120 from the first body member 110. The third body member 130 may be positioned rearward of the first weight port 124*a* and the second weight port 124*b* of the second body member 120. The third body member 130 is preferably made of a color different than the color of the second body member 120. The third body member 130 is preferably made of the same color as the first body member 110. The contrasting colors between the first body member 110 and the second body member 120 and the contrasting colors between the second body member 120 and the third body member 130 provides greater visibility when aligning the putter 100. The third body member 130 is made of a third material having a third density. In the most preferred embodiment, the third body member 130 is formed of steel and has a density of about 7 g/cc to 8 g/cc. The multiple body member construction described above provides more targeted weight distribution in the putter 100 for more forgiveness and improved sound and feel while also providing a greater degree of contrasting depths and colors to enhance the visual alignment of the putter 100 towards a target. Features described above also aid in proper assembly and protection of components from wear and unwanted disassembly.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus, the present invention should not be limited by the above-described exemplary embodiments but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

Other than in the operating examples, or unless otherwise expressly specified, all of the numerical ranges, amounts, values, and percentages may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

What is claimed is:

1. A putter comprising:

a first body member including a striking face and a rear portion extending rearward from said striking face in an address position;

a second body member coupled to said first body member below said rear portion of said first body member and rearward of said striking face in said address position;

a third body member coupled to said second body member below said second body member in said address position; and a face center plane that passes through a face center of said striking face and is perpendicular to a ground plane in said address position, wherein said first body member, said second body member, and said third body member are visible to a golfer in said address position, wherein said first body member is made from a first material having a first density, wherein said second body member is made from a second material having a second density, wherein said third body member is made from a third material having a third density, wherein said second density is less than said first density, and wherein said second density is less than said third density.

2. The putter of claim 1, wherein said first density is about 7 g/cc to 8 g/cc, said second density is about 2.5 g/cc to 3 g/cc, and said third density is about 7 g/cc to 8 g/cc.

3. The putter of claim 2, wherein said second body member includes a first weight port located toeward of said face center plane and a second weight port located heelward of said face center plane, wherein weights made from a fourth material having a fourth density are removably coupled to said first weight port and said second weight port, and wherein said fourth density is greater than said second density.

4. The putter of claim 3, wherein said second body member includes apertures in said first weight port and said second weight port which receive fasteners to couple said second body member to said first body member, and wherein said weights cover said fasteners.

5. The putter of claim 3, wherein said first material, said third material, and said fourth material are the same.

6. The putter of claim 2, wherein said second body member includes a groove which receives said rear portion of said first body member.

7. A putter comprising:

a first body member including a striking face and a rear portion extending rearward from said striking face in an address position;

a second body member coupled to said first body member below said rear portion of said first body member and rearward of said striking face in said address position;

a third body member coupled to said second body member below said second body member in said address position; and a face center plane that passes through a face center of said striking face and is perpendicular to a ground plane in said address position, wherein said first body member, said second body member, and said third body member are visible to a golfer in said address position, wherein said first body member comprises a color which contrasts with a color of said second body member, and wherein said color of said second body member contrasts with a color of said third body member.

8. The putter of claim 1, wherein said rear portion of said first body member comprises an upper surface having at least one sightline, wherein said second body member comprises a top surface having sightlines parallel to each other and spaced equidistant from said face center plane, and wherein said sightlines on said second body member are located a distance greater than 0.1 inches below said upper surface of said first body member in a direction perpendicular to said ground plane in said address position.

9. The putter of claim 1, wherein said third body member comprises at least one aperture which receives at least one projection from said second body member, and wherein said third body member has a central portion which covers at least one fastener used to couple said second body member to said first body member.

10. A putter comprising:

a first body member including a striking face and a rear portion extending rearward from said striking face in an address position;

a second body member coupled to said first body member below said rear portion of said first body member and rearward of said striking face in said address position;

a third body member coupled to said second body member below said second body member in said address position; and a face center plane that passes through a face center of said striking face and is perpendicular to a ground plane in said address position, wherein said first body member is made from a first material having a first density, wherein said second body member is made from a second material having a second density, wherein said third body member is made from a third material having a third density, wherein said second density is less than said first density, wherein said second density is less than said third density, wherein said first body member comprises at least one sightline, and wherein said second body member comprises a plurality of sightlines.

11. The putter of claim 10, wherein said at least one sightline on said first body member is a groove, a protrusion, or a painted line on an upper surface of said first body member, wherein said plurality of sightlines on said second body member are grooves, protrusions, or painted lines on a top surface of said second body member, wherein said at least one sightline on said first body member comprises a color which contrasts with a color of said first body member, wherein said plurality of sightlines on said second body member comprise a color which contrasts with a color of said second body member, and wherein said color of said first body member contrasts with said color of said second body member.

12. The putter of claim 11, wherein said third body member comprises a first projection located toeward of said face center plane and a second projection located heelward of said face center plane, wherein said first projection and said second projection are visible to a golfer in said address position, and wherein a color of said third body member contrasts with said color of said second body member.

13. The putter of claim 12, wherein said second body member includes a first weight port located toeward of said face center plane and a second weight port located heelward of said face center plane, wherein weights made from a fourth material having a fourth density are removably coupled to said first weight port and said second weight port, wherein said fourth density is greater than said first density, wherein said second body member includes apertures in said first weight port and said second weight port which receive fasteners to couple said second body member to said first body member, and wherein said weights cover said fasteners.

14. The putter of claim 13, wherein said second body member includes a groove which receives said rear portion of said first body member.

15. The putter of claim 14, wherein said third body member comprises at least one aperture which receives at least one projection from said second body member, and wherein said third body member has a central portion which covers at least one fastener used to couple said second body member to said first body member.

16. The putter of claim 10, wherein said plurality of sightlines on said second body member are parallel to each other and spaced equidistant from said face center plane, and wherein said plurality of sightlines on said second body member are located a distance greater than 0.1 inches below an upper surface of said first body member in a direction perpendicular to said ground plane in said address position.

17. The putter of claim 16, wherein said plurality of sightlines on said second body member are spaced apart by greater than 1 inch.

18. The putter of claim 17, wherein said at least one sightline on said first body member extends from said striking face to a rearmost edge of said rear portion of said first body member.

19. The putter of claim 10, wherein said rear portion of said first body member includes a cavity.

* * * * *